US011670311B2

(12) United States Patent
Tian et al.

(10) Patent No.: US 11,670,311 B2
(45) **Date of Patent: *Jun. 6, 2023**

(54) TIME DOMAIN SPECTRAL BANDWIDTH REPLICATION

(71) Applicant: Shure Acquisition Holdings, Inc., Niles, IL (US)

(72) Inventors: Wenshun Tian, Palatine, IL (US); Michael Ryan Lester, Colorado Springs, CO (US)

(73) Assignee: Shure Acquisition Holdings, Inc., Niles, IL (US)

( * ) Notice: Subject to any disclaimer, the term of this patent is extended or adjusted under 35 U.S.C. 154(b) by 92 days.

This patent is subject to a terminal disclaimer.

(21) Appl. No.: 17/228,365

(22) Filed: Apr. 12, 2021

(65) Prior Publication Data

US 2022/0028402 A1 Jan. 27, 2022

Related U.S. Application Data

(63) Continuation of application No. 16/682,984, filed on Nov. 13, 2019, now Pat. No. 10,978,083.

(51) Int. Cl.

| | |
|---|---|
| ***G10L 21/00*** | (2013.01) |
| ***G10L 19/00*** | (2013.01) |
| ***G10L 19/02*** | (2013.01) |
| ***G10L 19/12*** | (2013.01) |
| ***G10L 19/16*** | (2013.01) |

(52) U.S. Cl.
CPC ..... *G10L 19/0204* (2013.01); *G10L 19/12* (2013.01); *G10L 19/167* (2013.01)

(58) Field of Classification Search
CPC ..... G10L 19/00; G10L 19/02; G10L 21/00
See application file for complete search history.

(56) References Cited

U.S. PATENT DOCUMENTS

| | | | | |
|---|---|---|---|---|
| 6,691,085 | B1 * | 2/2004 | Rotola-Pukkila | G10L 21/0364 704/214 |
| 8,392,198 | B1 | 3/2013 | Berisha | |
| 8,959,017 | B2 | 2/2015 | Grill | |
| 9,424,847 | B2 | 8/2016 | Ishikawa | |
| 10,152,983 | B2 | 12/2018 | Choo | |
| 10,978,083 | B1 * | 4/2021 | Tian | G10L 21/0388 |
| 2005/0004793 | A1 | 1/2005 | Ojala | |
| 2010/0063812 | A1 | 3/2010 | Gao | |

(Continued)

FOREIGN PATENT DOCUMENTS

| | | | | |
|---|---|---|---|---|
| CN | 103928031 A * | 7/2014 | | G10L 19/02 |
| CN | 104036781 | 9/2014 | | |
| CN | 111210832 A * | 5/2020 | | |

OTHER PUBLICATIONS

Bäckström, "Speech Coding: with Code-Excited Linear Prediction," Chapter 11, Springer, Mar. 2017, 10 pp.

(Continued)

*Primary Examiner* — Shreyans A Patel
(74) *Attorney, Agent, or Firm* — Neal, Gerber & Eisenberg LLP

(57) ABSTRACT

A wireless audio system for encoding and decoding an audio signal using spectral bandwidth replication is provided. Bandwidth extension is performed in the time-domain, enabling low-latency audio coding.

20 Claims, 3 Drawing Sheets

(56) References Cited

U.S. PATENT DOCUMENTS

| | | | | |
|---|---|---|---|---|
| 2013/0117029 | A1* | 5/2013 | Liu | G10L 19/008 704/500 |
| 2013/0159005 | A1 | 6/2013 | Kikuiri | |
| 2016/0118056 | A1* | 4/2016 | Choo | G10L 19/0204 381/100 |
| 2017/0270944 | A1 | 9/2017 | Liu | |
| 2018/0308505 | A1 | 10/2018 | Chebiyyam | |

OTHER PUBLICATIONS

Baumeister, et al., "Full-HD Voice: Understanding the AAC codecs behind a new era in communication," EDN, <https://www.edn.com/Pdf/ViewPdf?contentItemId=4405424>, Jan. 22, 2013, 13 pp.
Berisha, et al., "Bandwidth Extension of Speech Using Perceptual Criteria," Chapter 2, Synthesis Lectures on Algorithms and Software in Engineering, Nov. 2013, 85 pp.
Brzuchalski, et al., "Low-delay and Ultra-Low-Delay coding in MPEG-4 AAC", IFAC Proceedings Volumes, vol. 45, Issue 7, 2012, 6 pp.
Chivukula, et al., "Fast Algorithms for Low-Delay SBR Filterbanks in MPEG-4 AAC-ELD," IEEE Transactions on Audio, Speech and Language Processing, vol. 20, Issue 3, Mar. 2012, 16 pp.
Dietz, et al., "Spectral Band Replication, a novel approach in audio coding," Audio Engineering Society Convention Paper 5553, May 10-13, 2002, 8 pp.
ETSI, Digital Radio Mondiale (DRM); System Specification, ETSI TS 101 980, V1.1.1, Sep. 2001, 158 pp.
ETSI, Universal Mobile Telecommunications System (UMTS); General audio codec audio processing functions; Enhanced aacPlus general audio codec; Encoder specification; Spectral Band Replication (SBR) part, ETSI TS 126 404, V6.0.0, Sep. 2004, 36 pp.
Fastl, et al., "Psychoacoustics—Facts and Models," 3rd Edition, Chapter 7, Springer-Verlag Berlin Heidelberg, 2007, 28 pp.
Gray, Jr., et al., "Distance Measures for Speech Processing," IEEE Transactions on Acoustics, Speech, and Signal Processing, vol. ASSP-24, No. 5, Oct. 1976, 12 pp.
International Search Report and Written Opinion for PCT/US2020/059860 dated Feb. 24, 2021, 13 pp.
ITU-R Recommendation BS.1387-1, "Method for objective measurements of perceived audio quality," 1998-2001, 100 pp.
ITU-T Recommendation G.729.1 (2006)—Amendment 3, International Telecommunication Union, Aug. 2007, 16 pp.
Lutzky, et al., "A guideline to audio codec delay," AES 116th Convention, May 2004, 10 pp.
Nagel, et al., "A Harmonic Bandwidth Extension Method for Audio Codecs," ICASSP 2009, 4 pp.
Nagel, et al., "A Phase Vocoder Driven Bandwidth Extension Method with Novel Transient Handling for Audio Codecs," Convention Paper 7711, Presented at the 126th AES Convention, May 7-10, 2009, 8 pp.
Neukam, et al., "A MDCT Based Harmonic Spectral Bandwidth Extension Method," ICASSP 2013, 5 pp.
Ragot, et al., "ITU-T G.729.1: An 8-32 KBIT/S Scalable Coder Interoperable with G.729 for Wideband Telephony and Voice Over IP," IEEE International Conference in Honolulu, Apr. 15-20, 2007, 4 pp.
Valin, et al., "A High-Quality Speech and Audio Codec With Less Than 10 ms Delay," IEEE Transactions on Audio, Speech, and Language Processing, vol. 18, Issue 1, Jan. 2010, 10 pp.
Valin, et al., "High-Quality, Low-Delay Music Coding in the Opus Codec," Presented at the 135th AES Convention, Oct. 17-20, 2013, 10 pp.
Vassilakis, "Perceptual attributes of acoustic waves—Pitch (Part I)", <http://acousticslab.org/psychoacoustics/PMFiles/Module05.htm>, 2013, 9 pp.
Wardle, "A Hilbert-Transformer Frequency Shifter for Audio," First Workshop on Digital Audio Effects, 1998, 5 pp.

* cited by examiner

TIME DOMAIN SPECTRAL BANDWIDTH REPLICATION

RELATED APPLICATION

This application is a continuation of U.S. patent application Ser. No. 16/682,984, filed on Nov. 13, 2019, the contents of which are incorporated herein by reference in their entirety.

TECHNICAL FIELD

This application generally relates to audio encoding and decoding. In particular, this application relates to methods and systems for time-domain spectral bandwidth replication for low-latency audio coding.

BACKGROUND

Spectral Bandwidth Replication (SBR) or Bandwidth Extension (BWE) is a bandwidth recovery technique in which the low band of the spectrum is encoded using a core codec while the high band is coarsely parameterized using spectrum envelope, gain, and control information with limited bits. Typically, high band SBR parameter estimations are done in the transfer domain, also known as the frequency domain (e.g., using DCT or a filter bank), which necessarily induces latency.

SBR reconstructs the high frequency components of an audio signal on the receiver side using minimal side information from the transmitter by working in parallel with an underlying core codec operating on the low frequency components. On the encoder side (otherwise known as the transmitter side), the SBR module estimates some perceptually vital information to ensure optimal high band recovery on the decoder side (otherwise known as the receiver side). The encoder may be incorporated into a transmitter, and the decoder incorporated into a receiver. The transmitted information has a very modest data rate, and typically includes spectrum envelope, gain, and T/F (Time/Frequency) grid info. The combination of the reconstructed high band signal with the core-decoded low band signal results in a full bandwidth decoded audio signal at the receiver.

One common theme among some conventional SBR techniques is that the major parameter estimation, such as spectrum envelope estimation, is not performed fully in the time domain but is instead performed in the transfer domain.

Accordingly, there is an opportunity for SBR that does not induce a large latency. More particularly, there is an opportunity for SBR that is performed fully in the time domain (as opposed to the transfer domain).

SUMMARY

The invention is intended to solve the above-noted problems by providing methods and systems for SBR wherein the bandwidth extension is performed fully in the time domain, enabling the SBR to be integrated into some codecs without any extra coding delay. This enables a reduced latency, leading to improved operational characteristics.

In an embodiment, a method operable by an audio system includes (A) encoding an audio signal, wherein the step of encoding the audio signal comprises: separating the audio signal into a high band signal and a low band signal; encoding the low band signal directly into an encoded low band codeword; classifying the high band signal to determine a high band signal type; determining a high band signal template by comparing a spectrum envelope corresponding to the high band signal to a plurality of templates; generating an artificial high band signal based on the high band signal template, and the high band signal type; determining a gain corresponding to the artificial high band signal; and determining a bit stream based on the encoded low band codeword and the high band signal template. The method also includes (B) transmitting the bit stream. And the method further includes (C) decoding the transmitted bit stream, wherein the step of decoding comprises: decomposing the transmitted bit stream into a received low band codeword and a received high band codeword; decoding the low band signal directly from the received low band codeword; determining the high band signal type, the gain, and the high band signal template from the received high band codeword; reconstructing a decoded high band signal based on the high band signal type, the gain, and the high band signal template; and combining the decoded low band signal and the reconstructed high band signal into a full band signal.

In another embodiment, a system for communicating an audio signal includes (A) an encoder, and (B) a decoder. The encoder is configured to: separate an audio signal into a high band signal and a low band signal; encode the low band signal directly into an encoded low band codeword; classify the high band signal to determine a high band signal type; determine a high band signal template by comparing a spectrum envelope corresponding to the high band signal to a plurality of templates; generate an artificial high band signal based on the high band signal and the high band signal type; determine a gain corresponding to the artificial high band signal; determine a bit stream based on the encoded low band codeword and the high band signal template; and transmit the bit stream. The decoder is configured to receive the bit stream; decompose the transmitted bit stream into a received low band codeword and a received high band codeword; decode the low band signal directly from the received low band codeword; determine the high band signal type, the gain, and the high band signal template from the received high band codeword; reconstruct a decoded high band signal based on the high band signal type, the gain, and the high band signal template; and combine the decoded low band signal and the reconstructed high band signal into a full band signal.

In a further embodiment, a non-transitory, computer-readable memory has instructions stored thereon that, when executed by a processor, cause the performance of a set of acts. The set of acts includes: (A) encoding an audio signal, (B) transmitting a bit stream, and (C) decoding the transmitted bit stream. The step (A) of encoding the audio signal includes separating the audio signal into a high band signal and a low band signal; encoding the low band signal directly into an encoded low band codeword; classifying the high band signal to determine a high band signal type; determining a high band signal template by comparing a spectrum envelope corresponding to the high band signal to a plurality of templates; generating an artificial high band signal based on the low band signal, the high band signal template, and the high band signal type; determining a gain corresponding to the artificial high band signal; and determining a bit stream based on the encoded low band codeword and the high band signal template. The step of decoding includes: decomposing the transmitted bit stream into a received low band codeword and a received high band codeword; decoding the low band signal directly from the received low band codeword; determining the high band signal type, the gain, and the high band signal template from the received high band codeword; reconstructing a decoded high band signal based on the high band signal type, the gain, the high band signal template, and the low band signal; and combine the decoded low band signal and the reconstructed high band signal into a full band signal.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
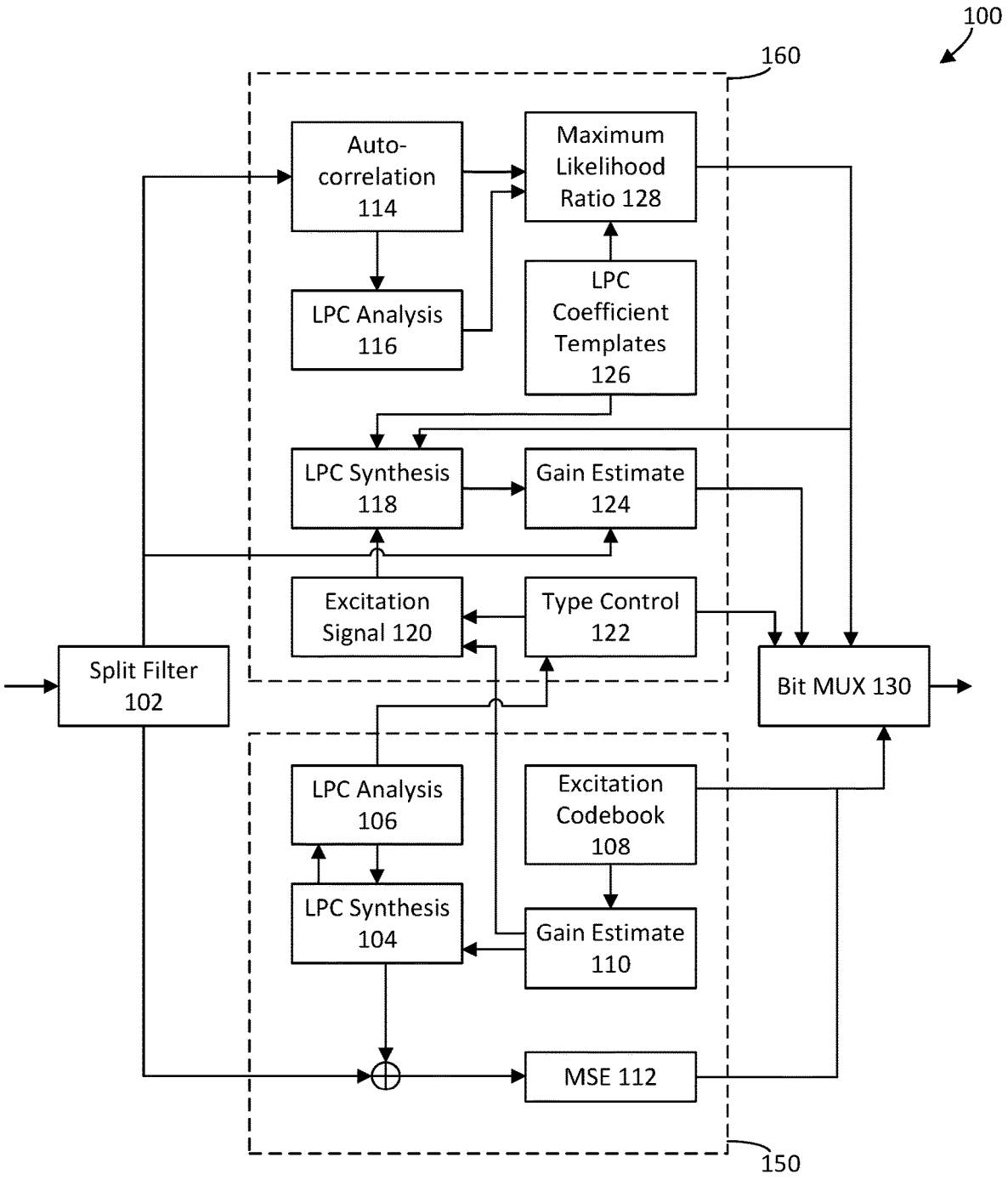
FIG. 1 is a simplified schematic diagram of an encoder, in accordance with some embodiments.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

As noted above, embodiments of the present disclosure are directed to performing SBR in the time domain with limited latency. In general, the use of SBR enables significantly improved performance for the same bit rate as compared with a traditional audio transmission that does not use SBR. This is because high frequency bands are less perceptually relevant to a person, meaning that less information is required for adequate representation. A coarse representation is sufficient for the high frequency bands, which provides significant advantages in reducing the quantity of bits required for transmission. And by limiting the bits needed for the high frequency bands, the low frequency bands, where a person's perception is relatively higher, can be represented using a higher or more optimal bitrate, without affecting the overall quality of the audio signal at the receiver.

Furthermore, embodiments of the present disclosure make use of two concepts: first, in some cases, high frequency components of an audio signal often have dependencies on the low frequency components. The high frequency components can be coarsely represented, and accurately reconstructed by the receiver based in part on the low frequency components. And second, in other cases, the high frequency components can have little to no dependency on the low frequency components. In these cases, additional information may be transmitted to enable accurate reconstruction of the high frequency components by the receiver.

Referring now to the Figures, FIG. 1 in particular illustrates an example encoder 100 according to various embodiments. Encoder 100 is configured to encode an audio signal. In the illustrated embodiment, the encoder 100 includes (1) a split filter 102, (2) a low band encoder 150, (3) a high band encoder 160, and (4) a multiplexer 130.

The split filter 102 is configured to receive the audio signal as an input. The split filter 102 is then configured to separate the input audio signal into a high band signal and a low band signal. The separation between the high band signal and the low band signal can be done at any given frequency. For example, the split filter 102 may split the input audio signal into a low band signal including frequencies in the range of 0-10 kHz, and a high band signal including frequencies in the range of 10-20 kHz. Other split points and frequency or bandwidth ranges can be utilized as well, and it should be understood that the 10 kHz demarcation is included here solely as an example.

In some cases, the high band signal and the low band signal can have the same bandwidth (e.g., each comprising 10 kHz). Alternatively, the high band signal and the low band signal can have different bandwidths.

Furthermore, either or both of the low band signal and the high band signal can be further separated into multiple separate sub-bands. For example, the high band signal can be further split into a high high band signal and a low high band signal. Each sub-band of the low or high band signals can have the same bandwidth (e.g., each comprising 5 kHz), or they may have a different bandwidth (e.g., a first sub-band comprising 4 kHz and a second sub-band comprising 6 kHz).

In some examples, the split filter 102 comprises a quadrature mirror filterbank (QMF). In other examples, another kind of filterbank may be used.

The high band signal and the low band signal are processed by the high band encoder 160 and the low band encoder 150 in parallel.

The low band encoder 150 is configured to encode the low band signal from the split filter 102 directly into an encoded low band codeword. This codeword can then be transmitted to the decoder (described in further detail below), and the decoder can reconstruct the low band signal from the transmitted low band codeword. To carry out the task of encoding the low band signal, the low band encoder 150 of the illustrated embodiment can include a linear predictive coding (LPC) synthesis block 104, an LPC analysis block 106, an excitation codebook 108, a gain estimate block 110, and a mean square error block 112. The blocks 104, 106, 108, 110, and 112 together form a code-excited linear predictive coding (CELP) based encoder.

The low band encoder 150 is illustrated as including the blocks noted above. However, it should be appreciated that the low band encoder can alternatively include different blocks or additional blocks that provide different or additional functionality. The low band encoder 150, however, is configured to encode the low band signal using a core encoder, regardless of the specific names of the blocks of the encoder 150. Low band encoder 150 shown in FIG. 1 is one example of a core encoder, that illustrates a CELP encoder. In other examples, the core encoder can be any type of analysis-by-synthesis encoder.

The high band encoder 160 is configured to encode the high band signal output by the split filter 102, among other functions. To carry out these functions, the high band encoder 160 in the illustrated embodiment includes an auto correlation block 114, an LPC analysis block 116, an LPC synthesis block 118, an excitation signal block 120, a type control block 122, a gain estimate block 124, LPC coefficient templates 126, and a maximum likelihood ratio block 128. These blocks are connected and arranged in such a way that the high band encoder 160 is configured to carry out the various functions described below. However, it should be understood that various other arrangements, substitute components, and/or additional components may be used as well, and the same functions may still be carried out.

In the illustrated embodiment, the high band encoder 160 is configured to: (1) classify the high band signal output by the split filter 102 to determine a high band signal type. Classifying the high band signal can include determining whether the high band signal includes high-pitched harmonics, low-pitched harmonics, or no harmonics. The high-pitched harmonics may be harmonics based on the low band signal, which are present in the high band signal. In some examples, the determination of whether the high band signal includes high-pitched harmonics includes a determination based on the fundamental frequency and sampling frequency of the input audio signal.

In an example embodiment, a first signal type of the high band signal includes high-pitched harmonics, and a second signal type does not include high-pitched harmonics. The second signal type may or may not include low pitch harmonics. Classifying the high band signal as either the first signal type or the second signal type can be done in part by the type control block 122. Further, the determination of the signal type of the high band signal can be based on an index determined during LPC synthesis, where the index corresponds to the harmonicity of the high band signal. If the index for a given high band signal is greater than or equal to a particular threshold, that high band signal may be deemed the first signal type (i.e., including high-pitched harmonics). Alternatively, if the index is less than the threshold, the high band signal may be deemed the second signal type (i.e., not including high-pitched harmonics).

The high band encoder 160 shown in the illustrated embodiment is also configured to: (2) determine a high band signal template corresponding to the high band signal, by comparing a spectrum envelope corresponding to the high band signal to a plurality of templates.

The spectrum envelope corresponds to an envelope of the amplitude of the high band signal. Due to the limited human perception of pitch and spectral fine structure at high frequencies, and since critical bands of simultaneous masking are wider at high frequencies, spectral fine structure is subject to strong masking effects. As such, coarse estimation of the high band signal, using the spectrum envelope, becomes possible using limited bits.

The plurality of templates can refer to a plurality of LPC coefficients templates that are previously generated and stored for selection based on similarities to high band signal (in particular, the spectrum envelope). In some examples, the templates may include varying numbers of coefficients or "entries." Furthermore, in some examples a subset of templates may be used for comparison based on the fundamental frequency of the input audio signal. In a particular example, the LPC coefficients templates (e.g., codebook) can be divided into a first subset of templates (e.g., a plurality of templates including 16 entries) for flat tilt spectrum dedicated for low-pitch and mid-pitch zones (i.e., low and mid-range fundamental frequencies), and a second subset of templates (e.g., a plurality of templates including 48 entries) for harmonics in a high-pitch range with a relatively high fundamental frequency. In one example, the fundamental frequency ranges from 0-200 Hz for low-pitch, 200-600 Hz for mid-pitch, and 600 Hz and above for high-pitch. The templates can be generated to run the LPC analysis on the signals which are composed to reflect the spectrum properties of the tilt spectrum or harmonic fine structures. For the first subset of templates (i.e., the 16-entry templates) based on a flat tilt spectrum, the first template is completely flat, and the next template is attenuated by −2 dB more tilt within the high band signal bandwidth sequentially. For the second subset of templates (i.e., the 48-entry templates) based on a harmonic spectrum, a −20 dB tile slope crossing the high band signal bandwidth is applied. Based on the low bit rate, the LPC templates may not provide different slopes and may not cover harmonics with a fundamental frequency higher than a particular threshold (e.g., 1221 Hz). It should be appreciated that the values provided in the example above are for illustrative purposes only, and that various other values, quantity of entries per template, thresholds, and barriers between low-pitch, mid-pitch, and high-pitch may be used. Furthermore, although the same templates are used for both low-pitch and mid-pitch zones in the example above, it should be appreciated that in some examples different templates may be used for each zone.

In some examples, the subset of templates used, or the characteristics of the templates used (i.e., the number of entries) can depend on the content of the input audio signal. For example, where the input audio signal is "unvoiced," only the first subset (i.e., 16-entry templates) is used. In cases where the input audio signal is "voiced," both subsets (i.e., 16-entry and 48-entry templates) are used. In voiced cases, if the fundamental frequency is lower than a particular threshold (e.g., 600 Hz), the most likely template for a match to the spectrum envelope will be within the first subset of 16-entry flat tilt spectrum templates. This is because the high-pitch zone harmonic templates differ more from the low-pitch and mid-pitch zone's coefficients in a maximum likelihood ratio.

In some examples, the template is determined from the plurality of templates by comparing the spectrum envelope of high band signal to the plurality of templates, or a subset of the plurality of templates as noted above. The exact template selected can be determined by performing a maximum likelihood ratio analysis of the high band signal (i.e., the spectrum envelope) and each template. This analysis can be done by the maximum likelihood ratio block 128.

The high band encoder 160 shown in the illustrated embodiment is also configured to: (3) generate an artificial high band signal based on the high band signal template and the high band signal type. Generation of the artificial high band signal can also include using an excitation signal, which can be selected from one or more sources. The excitation signal can be selected based on the high band signal type.

In some examples, the excitation signal can be an uncorrelated excitation signal, such as white noise. If the high band signal type is the first signal type noted above (i.e., the high band signal includes high-pitched harmonics), the artificial high band signal may be generated using the uncorrelated excitation signal.

Alternatively, the excitation signal can be a core excitation signal based on the low band signal. If the high band signal type is the second signal type noted above (i.e., the high band signal does not include high-pitched harmonics), the artificial high band signal may be generated using the core excitation signal based on the low band signal.

The high band encoder 160 shown in the illustrated embodiment is further configured to: (4) determine a gain corresponding to the artificial high band signal. The gain information corresponding to the artificial high band signal is used for smoothing control of the higher band and compensates for the mismatch between the excitation energy from the excitation signal and the gain of the LPC synthesis filter. In other words, the gain corresponding to the artificial high band signal is used by the decoder to adjust a gain applied to the template in reconstructing the high band signal. The high band encoder 160 can perform gain matching between the high band signal template and the high band signal.

The multiplexer 130 of the encoder 100 may be configured to generate a bit stream based on the encoded low band codeword (from the low band encoder 150) and the high band signal template (from the high band encoder 160). The bit stream can also include various other information, such as the high band signal type and the determined gain.

Encoder 100 may then be configured to transmit the bit stream to the decoder 200.

Figure 2:
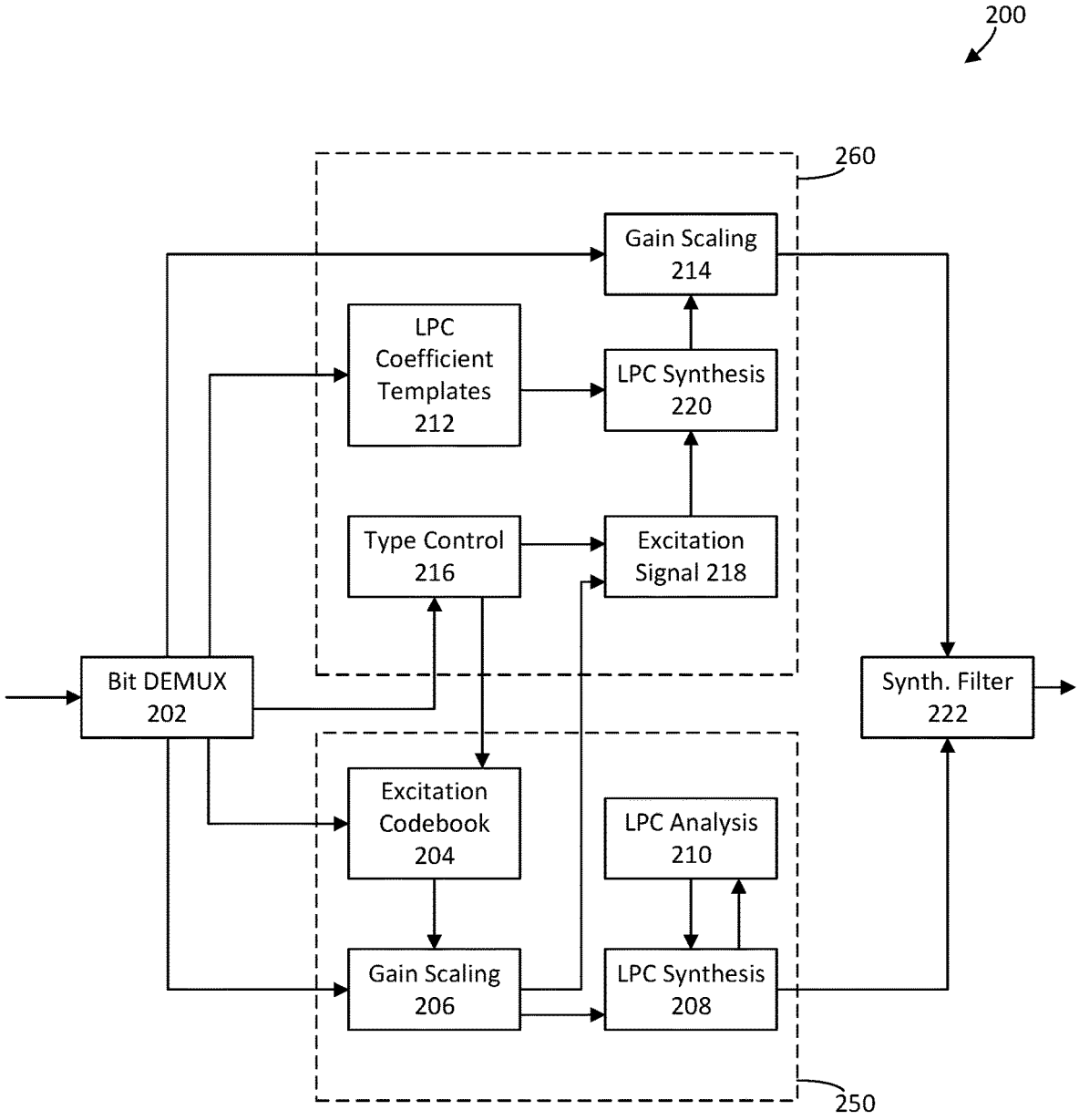
FIG. 2 is a simplified schematic diagram of a decoder, in accordance with some embodiments.

FIG. 2 illustrates an example decoder 200 according to various embodiments. The decoder 200 of the illustrated embodiment is configured to decode the received bit stream into a received audio signal. In the illustrated embodiment, the decoder 200 includes (1) a demultiplexer 202, (2) a low band decoder 250, (3) a high band decoder 260, and (4) a synthesis filter 222.

The demultiplexer 202 is configured to decompose or split the received bit stream into its component parts, including a low band codeword and high band codeword. The low band codeword and the high band codeword can include additional information, such as the high band template, the gain, the high band signal type, etc.

The low band codeword and the high band codeword can be processed by the low band decoder 250 and the high band decoder 260 in parallel.

The low band decoder 250 shown in the illustrated embodiment is configured to decode the low band signal directly from the received low band codeword. To carry out this task of decoding the received low band codeword, the low band decoder 250 can include an excitation codebook 204, a gain scaling block 206, an LPC synthesis block 208, and an LPC analysis block 210. The blocks 204, 206, 208, and 210 together can form a code-excited linear predictive coding (CELP) based decoder.

The low band decoder 250 is illustrated as including the blocks noted above. However, it should be appreciated that the low band decoder can alternatively include different blocks or additional blocks that provide different or additional functionality. The low band decoder 250, however, is configured to decode the low band signal using a core decoder, regardless of the specific names of the blocks of the decoder used 250. Low band decoder 250 shown in FIG. 2 is one example of a core decoder, that illustrates a CELP decoder. In other examples, the core decoder can be any type of analysis-by-synthesis decoder.

The high band decoder 260 is configured to decode the high band codeword from the received bit stream into a received high band signal, among other functions. To carry out these functions, the high band decoder 260 in the illustrated embodiment includes LPC coefficient templates 212, a gain scaling block 214, a type control block 216, an excitation signal block 218, and an LPC synthesis block 220. These blocks are connected and arranged in such a way that the high band decoder 260 is configured to carry out the various functions listed below. However, it should be understood that various other arrangements, substitute components, and/or additional components may be used as well, and the same functions may still be carried out.

In the illustrated embodiment, the high band encoder 260 is configured to: (1) determine the high band signal type, the gain, and the high band signal template from the received high band codeword. This can be done by analyzing the received high band codeword, and parsing out the various control information included therein.

The high band decoder 260 is also configured to: (2) reconstruct the high band signal based on the received high band signal type, the gain, and the high band signal template determined by the high band decoder 260. In some examples, reconstructing the high band signal can include using an excitation signal, along with the high band signal template, high band signal type, and gain.

As noted above with respect to the encoder 100, the excitation signal can be an uncorrelated excitation signal, or can be a core excitation signal based on the low band signal. A determination of which excitation signal to use can depend on the signal type of the high band signal, as determined by the decoder 200. Where the signal type is the first signal type (i.e., the high band signal includes high-pitched harmonics), the high band decoder 260 may use the uncorrelated excitation signal. However, where the signal type is the second signal type (i.e., the high band signal does not include high-pitched harmonics), the high band decoder 260 may instead use the core excitation signal based on the low band signal.

The decoder 200 also includes a synthesis filter 222, which is configured to synthesize a received full band audio signal from the decoded low band signal from the low band decoder 250 and the reconstructed high band signal from the high band decoder 260. The received full band audio signal can then be played back via a speaker, stored in memory, or otherwise acted upon in various ways.

It should be understood that the example embodiment described above and shown in FIGS. 1 and 2 is only one way of accomplishing the functions described herein. Various other examples and embodiments may accomplish the same functions using different components and operations.

Furthermore, one or more variations on the examples disclosed herein can be used. For example, the encoder 100 (via the split filter 102) can separate the input audio signal into two or more low band signals and/or two or more high band signals, rather than a single low band signal and a single high band signal. Separation into two or more low band signals and two or more high band signals can be based on the type corresponding to a given band of the input audio signal. For example, a high band signal of the input audio signal may include a section comprising a first signal type, including high pitched harmonics and include a second section comprising a second signal type, not including high-pitched harmonics. These bands may be separated into a first high band signal and a second high band signal, such that they can be independently encoded and decoded.

Furthermore, the example encoder 100 and/or decoder 200 may be implemented in one or more computing devices or systems. Encoder 100 and/or decoder 200 may include one or more computing devices, or may be part of one or more computing devices or systems. As such, encoder 100 and/or decoder 200 may include one or more processors, memory devices, and other components that enable the encoder 100 and decoder 200 to carry out the various functions described herein.

Figure 3:
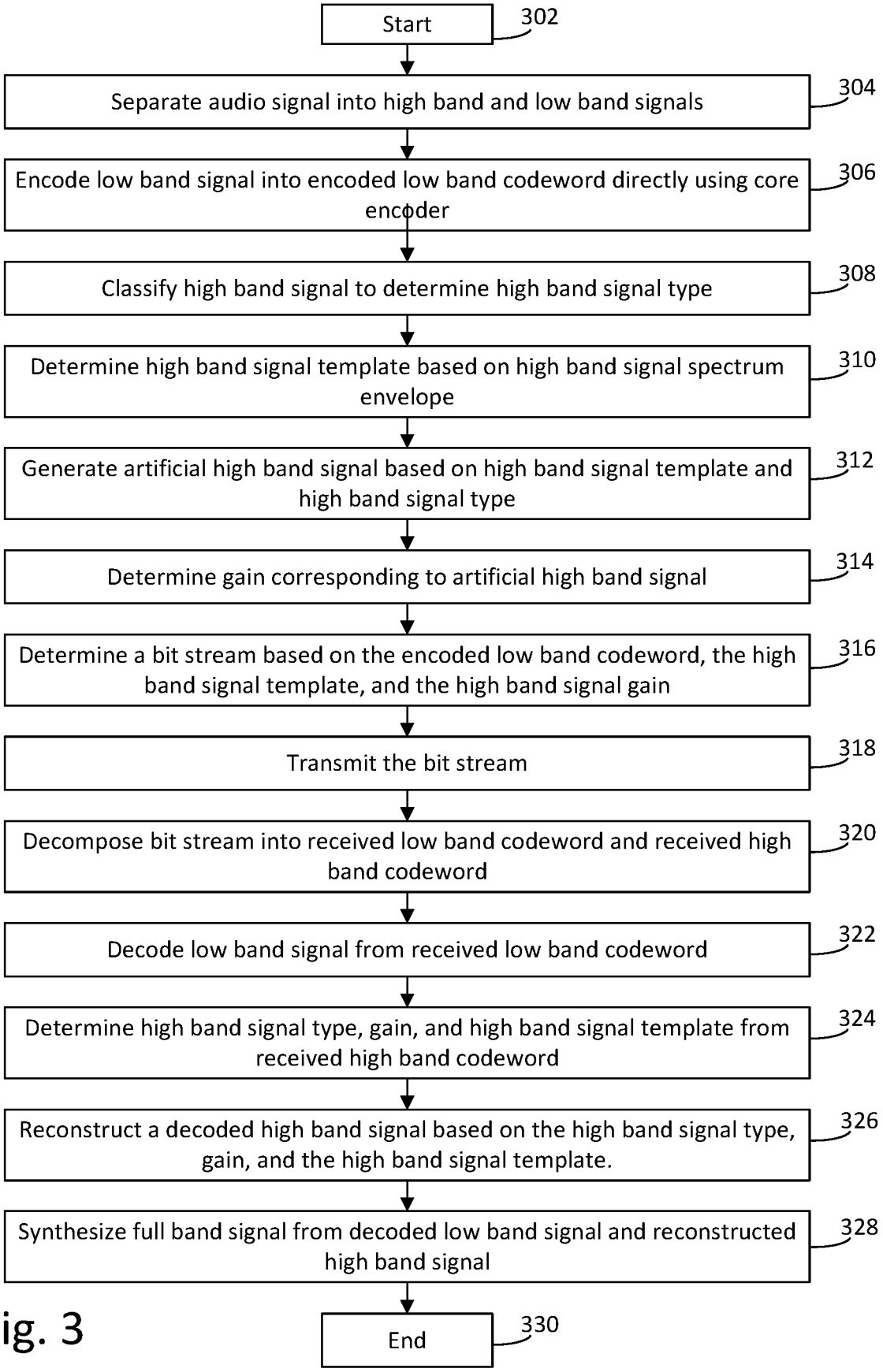
FIG. 3 is a flowchart illustrating an example method, in accordance with some embodiments.

FIG. 3 illustrates a flow chart of an example method 300 according to embodiments of the present disclosure. Method 300 may enable spectral bandwidth replication performed in the time-domain, for low latency audio coding. The flowchart of FIG. 3 is representative of machine readable instructions that are stored in memory and may include one or more programs which, when executed by a processor may cause one or more computing devices and/or systems to carry out one or more functions described herein. While the example program is described with reference to the flowchart illustrated in FIG. 3, many other methods for carrying out the functions described herein may alternatively be used. For example, the order of execution of the blocks may be rearranged or performed in series or parallel with each other, blocks may be changed, eliminated, and/or combined to perform method 300. Further, because method 300 is disclosed in connection with the components of FIGS. 1-2, some functions of those components will not be described in detail below.

Method 300 starts at block 302. At block 304, method 300 includes separating an audio signal into high band and low band signals. As noted above, this can include using a split filter to separate the high frequency components from the low frequency components. The high band signal and the low band signal may have the same or different bandwidths, and can be separated at any suitable frequency.

At block 306, method 300 includes encoding the low band signal into an encoded low band codeword directly using a core encoder. As noted above, this can include using a CELP encoder, including an LPC synthesis block, an LPC analysis block, an excitation codebook, a gain estimate block, and a mean square error block. However, various other core encoders can be used as well.

At block 308, method 300 includes classifying the high band signal to determine a high band signal type. The high band signal type can depend on a harmonicity of the high band signal, or whether or not the high band signal includes high-pitched harmonics. If the high band signal includes high-pitched harmonics, it may be deemed a first type signal. Alternatively if the high band signal does not include high-pitched harmonics, it may be deemed a second type signal.

At block 310, method 300 includes determining a high band signal template based on the high band signal spectrum envelope. As noted above, this can include comparing the spectrum envelope of the high band signal to a plurality of templates. The templates used can be a subset of all available templates, and can be selected based on the fundamental frequency and sampling frequency of the input audio signal.

At block 312, method 300 includes generating an artificial high band signal based on the high band signal template and the high band signal type. As noted above, this can also include generating the artificial high band signal based on an excitation signal, where the excitation signal is selected based on the high band signal type (i.e., either first type or second type). Where the high band signal is the first type, the excitation signal can be an uncorrelated excitation signal. And where the high band signal is the second type, a core excitation signal based on the low band signal can be used.

At block 314, method 300 includes determining the gain corresponding to the artificial high band signal. As noted above, the gain information can be used for smoothing control of the high band signal, and compensates for a mismatch between the excitation signal energy and the gain of the LPC synthesis filter.

At block 316, method 300 includes determining a bit stream based on the encoded low band codeword and the high band signal template. This can also include determining the bit stream based on the high band signal gain. Further examples can include determining the bit stream based on the high band codeword, which includes a high band template index and a high band gain index. Block 318 includes transmitting the bit stream.

At block 320, method 300 includes decomposing the bit stream into a received low band codeword and a received high band codeword. As noted above, this can be done by using a demultiplexer.

At block 322, method 300 includes decoding a received low band signal from the received low band codeword. The received low band signal can be decoded directly using a core decoder, such as a CELP based decoder.

At block 324, method 300 includes determining the high band signal type, gain, and high band signal template from the received high band codeword.

At block 326, method 300 includes reconstructing a decoded high band signal based on the high band signal type, gain, and the high band signal template. This can otherwise be described as generating a reconstructed high band signal, reconstructing the original high band signal, or some other mechanism for reproducing the high band signal from the input audio signal as accurately as is feasible. As noted above, reconstructing the decoded high band signal can also include using an excitation signal selected based on the signal type. The excitation signal can be either an uncorrelated excitation signal, or a core excitation signal based on the low band signal (or decoded low band signal at the decoder).

At block 328, method 300 includes synthesizing a received full band audio signal from the decoded low band signal and the reconstructed high band signal. Method 300 may then end at block 330.

Any process descriptions or blocks in figures should be understood as representing modules, segments, or portions of code which include one or more executable instructions for implementing specific logical functions or steps in the process, and alternate implementations are included within the scope of the embodiments of the invention in which functions may be executed out of order from that shown or discussed, including substantially concurrently or in reverse order, depending on the functionality involved, as would be understood by those having ordinary skill in the art.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. A method operable by an audio system, the method comprising:
encoding an audio signal, wherein the step of encoding the audio signal comprises:
separating the audio signal into a high band signal and a low band signal;
encoding the low band signal into an encoded low band codeword;
determining a high band signal template by comparing a spectrum envelope corresponding to the high band signal to a plurality of templates;
generating a bit stream based on the encoded low band codeword and the high band signal template; and
transmitting the bit stream.

2. The method of claim 1, wherein the step of encoding the audio signal further comprises:
classifying the high band signal to determine a high band signal type;
generating an artificial high band signal based on the high band signal template and the high band signal type; and
determining a gain corresponding to the artificial high band signal.

3. The method of claim 2, wherein:
the low band signal is encoded in a time domain, and
the artificial high band signal is generated in the time domain.

4. The method of claim 3, wherein the high band signal type comprises either (i) a first type, wherein the first type includes high-pitched harmonics, or (ii) a second type, wherein the second type does not include high-pitched harmonics.

5. The method of claim 4, wherein the high band signal type comprises the first type, and wherein generating the artificial high band signal comprises using an uncorrelated excitation signal.

6. The method of claim 4, wherein the high band signal type comprises the second type, and wherein generating the artificial high band signal comprises using the low band signal as an excitation signal.

7. The method of claim 1, wherein determining the high band signal template comprises determining the high band signal template based on a maximum likelihood ratio analysis of the high band signal.

8. The method of claim 1, wherein encoding the audio signal further comprises gain matching the high band signal template to the high band signal.

9. The method of claim 1, wherein:
encoding the low band signal comprises encoding the low band signal into the encoded low band codeword using Code-Excited Linear Prediction Coding,
wherein the plurality of templates comprise Linear Prediction Coding templates.

10. A method operable by an audio system, the method comprising:
receiving a bit stream; and
decoding the bit stream, wherein decoding the bit stream comprises:
decomposing the bit stream into a received low band codeword and a received high band codeword;
decoding a low band signal from the received low band codeword;
determining a high band signal type, a gain, and a high band signal template from the received high band codeword;
reconstructing a decoded high band signal based on the high band signal type, the gain, and the high band signal template; and
combining the low band signal and the decoded high band signal into a full band signal.

11. The method of claim 10, wherein:
decoding the low band signal comprises determining the low band signal directly from the received low band codeword using Code-Excited Linear Prediction Coding.

12. The method of claim 10, further comprising:
reconstructing the decoded high band signal based on the received high band codeword and an excitation signal, wherein the excitation signal comprises either (i) an uncorrelated excitation signal, or (ii) a core excitation signal based on the low band signal.

13. The method of claim 12, wherein the high band signal type comprises a first type in which a high band signal comprises high-pitched harmonics, and wherein the excitation signal comprises the uncorrelated excitation signal.

14. The method of claim 10, wherein:
decoding the low band signal comprises decoding the low band signal from the received low band codeword in a time domain;
reconstructing the decoded high band signal comprises reconstructing the decoded high band signal based on the high band signal type, the gain, and the high band signal template in the time domain; and
combining the low band signal and the decoded high band signal comprises combining the low band signal and the decoded high band signal into the full band signal in the time domain.

15. A method operable by an audio system, the method comprising:
(A) encoding an audio signal, wherein the step of encoding the audio signal comprises:
separating the audio signal into a high band signal and a low band signal;
encoding the low band signal directly into an encoded low band codeword;
determining a high band signal template based on the high band signal; and
determining a bit stream based on the encoded low band codeword and the high band signal template;
(B) transmitting the bit stream; and
(C) decoding the transmitted bit stream, wherein the step of decoding comprises:
decomposing the transmitted bit stream into a received low band codeword and a received high band codeword;
decoding the low band signal directly from the received low band codeword;
reconstructing a decoded high band signal based on the received high band codeword; and
combining the low band signal and the high band signal into a full band signal.

16. The method of claim 15, wherein the step of encoding the audio signal further comprises:
determining the high band signal template by comparing a spectrum envelope corresponding to the high band signal to a plurality of templates.

17. The method of claim 15, wherein the step of encoding the audio signal further comprises:

classifying the high band signal to determine a high band signal type;

generating an artificial high band signal based on the high band signal template and the high band signal type; and determining a gain corresponding to the artificial high band signal.

18. The method of claim 17, wherein the high band signal type comprises either (i) a first type, wherein the first type includes high-pitched harmonics, or (ii) a second type, wherein the second type does not include high-pitched harmonics, and wherein generating the artificial high band signal comprises:

using an uncorrelated excitation signal when the high band signal comprises the first type; and using the low band signal as an excitation signal when the high band signal comprises the second type.

19. The method of claim 15, wherein the step of decoding the audio signal further comprises:

determining a high band signal type, a gain, and the high band signal template from the received high band codeword; and reconstructing the decoded high band signal based on the high band signal type, the gain, and the high band signal template.

20. The method of claim 19, wherein the high band signal type comprises either (i) a first type, wherein the first type includes high-pitched harmonics, or (ii) a second type, wherein the second type does not include high-pitched harmonics, wherein the step of decoding the transmitted bit stream further comprises:

reconstructing the decoded high band signal based on the received high band codeword and an excitation signal, wherein the excitation signal comprises either (i) an uncorrelated excitation signal, or (ii) a core excitation signal based on the low band signal;

using the uncorrelated excitation signal when the high band signal is the first type; and using the core excitation signal based on the low band signal when the high band signal is the second type.

* * * * *